US009346596B2

(12) United States Patent
Hanks et al.

(10) Patent No.: US 9,346,596 B2
(45) Date of Patent: May 24, 2016

(54) PAPERBOARD SECURITY CARD WITH CONTENT RETAINING ELEMENTS

(75) Inventors: Charlotte Hanks, Toronto (CA); Matthew E. Zacherle, Chesterfield, VA (US)

(73) Assignee: WestRock MWV, LLC, Norcross, GA (US)

( * ) Notice: Subject to any disclaimer, the term of this patent is extended or adjusted under 35 U.S.C. 154(b) by 361 days.

(21) Appl. No.: 14/001,091

(22) PCT Filed: Feb. 15, 2012

(86) PCT No.: PCT/US2012/025245
§ 371 (c)(1), (2), (4) Date: Aug. 22, 2013

(87) PCT Pub. No.: WO2012/115836
PCT Pub. Date: Aug. 30, 2012

(65) Prior Publication Data

US 2013/0327673 A1 Dec. 12, 2013

Related U.S. Application Data

(60) Provisional application No. 61/446,174, filed on Feb. 24, 2011.

(51) Int. Cl.
*B65D 73/00* (2006.01)

(52) U.S. Cl.
CPC ..... *B65D 73/0035* (2013.01); *B65D 73/0085* (2013.01); *B65D 73/0092* (2013.01)

(58) Field of Classification Search
CPC ..... B65D 73/0035; B65D 73/0085; B65D 73/0092
USPC ..... 206/461–471, 488, 806
See application file for complete search history.

(56) References Cited

U.S. PATENT DOCUMENTS

| | | | | |
|---|---|---|---|---|
| 2,304,683 | A | 12/1942 | Finn | |
| 2,712,397 | A | 7/1955 | Kowal | |
| 2,828,856 | A | 4/1958 | Deakers | |
| 3,541,599 | A * | 11/1970 | Roberts | B65D 5/0085 206/457 |
| 3,796,306 | A | 3/1974 | Swezey | |
| 3,888,349 | A | 6/1975 | MacFarland | |
| 3,908,827 | A | 9/1975 | Bemmels et al. | |
| 3,990,578 | A * | 11/1976 | Roeser | B65D 73/0085 206/461 |
| 5,379,894 | A * | 1/1995 | Haas | B65D 5/4208 206/461 |
| 5,394,913 | A | 3/1995 | Zezza et al. | |
| 5,595,047 | A * | 1/1997 | Paumen | B65D 71/16 206/705 |
| 5,947,297 | A * | 9/1999 | Aoki | B65D 73/0085 206/446 |
| 5,988,372 | A | 11/1999 | Kawagoe et al. | |
| 6,321,906 | B1 | 11/2001 | Wein | |
| 6,676,584 | B2 | 1/2004 | Tachikawa et al. | |

(Continued)

FOREIGN PATENT DOCUMENTS

EP 0897874 A1 5/2003

OTHER PUBLICATIONS

International Search Report and Written Opinion issued in PCT/US2012/025245, Feb. 15, 2012.

*Primary Examiner* — Luan K Bui
(74) *Attorney, Agent, or Firm* — WestRock Intellectual Property Group

(57) ABSTRACT

Paperboard security packages (1) are disclosed wherein content items are contained by at least one card (10) and two adjoining housing (30, 40) attached to the at least one card and protruding from opposite surfaces of the card.

20 Claims, 11 Drawing Sheets

(56) References Cited

U.S. PATENT DOCUMENTS 7,621,405 B2 * 11/2009 Schweitzer ..... B65D 73/0092 206/463

2007/0209957 A1 * 9/2007 Glenn ..... A61B 19/02 206/462

2010/0270199 A1 * 10/2010 Nazari ..... B65D 5/5038 206/488

* cited by examiner

PAPERBOARD SECURITY CARD WITH CONTENT RETAINING ELEMENTS

REFERENCE TO RELATED APPLICATIONS

This application is a National Phase entry into the United States of International Application PCT/US12/25245 filed on Feb. 15, 2012 which claims the benefit of priority under 35 U.S.C. §119(e) of U.S. provisional application Ser. No. 61/446,174 filed on Feb. 24, 2011, and both of the above applications are hereby incorporated by reference in their respective entireties.

BACKGROUND

The present application is directed to security packages and, more particularly, to a paperboard security card with formed content-retaining elements. In one embodiment the package is a security card/package predominantly formed from paper board.

In one embodiment the package includes front and rear opposing cards or panels, with a content-retaining housing protruding from at least one of the front and rear surfaces to retain, secure and display content. The opposing cards as well as the content-retaining housings may be made of paper board and can include a non paper based layer that prevents or limits tearing, access and or disassembly of the package to gain access to package. The content-retaining housings may be formed as an extension of one or both cards, or as parts initially separate from the cards. The content-retaining housings may protrude through a content aperture in one or both cards.

The package has a reduced number of components and removes the need for a vacuumed form structure as may typically be used in blister card security packaging. The package may be shipped to a converting and finishing location in a partially preformed state and or in a flat or semi flat state. The package may be formed from a single sheet or card that is then folded, formed and bonded into a finished structure.

Manufacturers and retailers of consumer goods, such as pharmaceuticals, electronics, health and beauty products and the like, typically package their products in tamper resistant security packages. For example, many consumer goods are packaged in blister or clamshell packages formed by positioning a consumer good in a flanged blister made from various polymeric and/or paperboard materials and sealing the flanged blister between two paperboard substrates. Consumers have voiced disapproval of such packages because of the difficulty of opening the same and the potential for being cut on a rough edge especially of plastic blisters. Packages may therefore be made based largely on paperboard, for example, NATRALOCK packages. Packaging made primarily of paperboard is more sustainable than packaging made from petroleum-based plastics. The paperboard used in such packages may be tear-resistant as described in commonly assigned U.S. Pat. No. 7,144,635.

It would be useful to have a security package that has provides tear-resistant, tamper-resistant, and theft-resistant features, allowing visibility of a product without necessarily using a transparent blister material such as plastic.

SUMMARY

In one aspect, a package is disclosed for holding an item, the package including at least one card with a content aperture, the card having first and second opposing surfaces, and a first content housing protruding away from the first opposing surface and at least partly enclosing a first volume, with a second content housing protruding away from the second opposing surface and at least partly enclosing a second volume, wherein the first and second volumes are connected through the content aperture.

Other aspects of the disclosed packaging structures will become apparent from the following description and the accompanying drawings.

DETAILED DESCRIPTION

Figure 1:
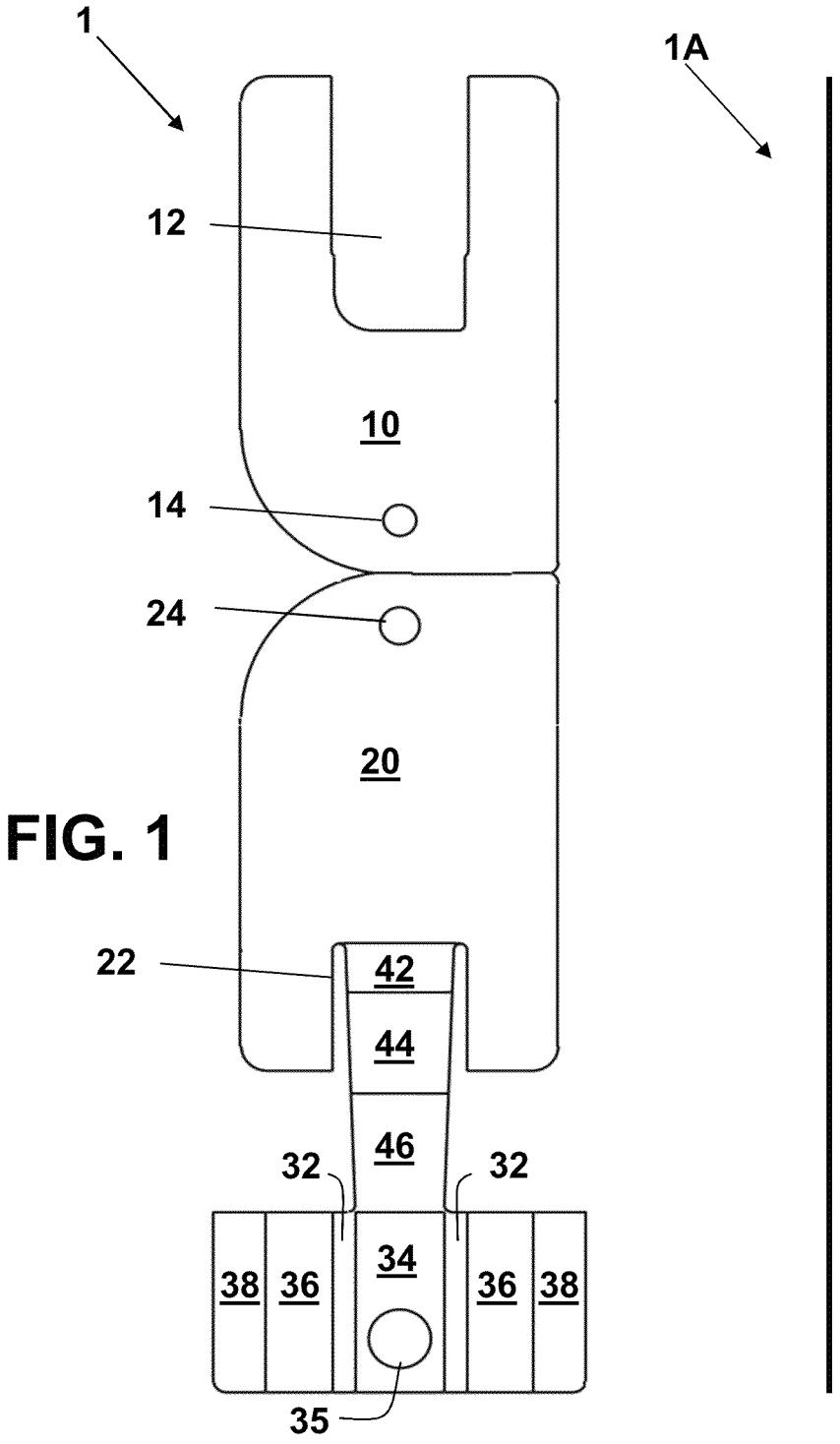
FIG. 1 shows a plan view and side view of a blank for forming an exemplary package.

Reference will be made to FIGS. 1-11 which show exemplary embodiments of paperboard security packages. Where there is more than one of the same feature, sometimes only one will be denoted by a reference numeral. If different packages have a common feature, it may only be described one time. Similar features are sometimes denoted by the same numeral even if not identical. Where assembly steps are described, these steps are exemplary and are not to be limiting as to the sequence of operations used to arrive at the final package. Also, directions such as up, down, top, bottom, front, back, etc. are used for convenience in describing the package and are not meant to be limiting. The packages described may be made of one or several blanks (that is, the cut sheet parts from which the package components are made by folding and other steps). However, it should be understood that certain unitary blanks may be provided instead as more than one part, and certain blanks may be combined into single blanks, while still arriving at the same finished package.

The packages are shown holding example contents in the form of an irregularly-shaped item such as a cartridge for an inkjet printer; however, other shapes of contents may also be held in the packages. One content item is shown in each package; however two or more content items may be held be appropriate modifications to the package.

FIG. 1 shows a plan view of a blank for forming a package 1 including a front card 10 that may have a content aperture 12 and a rear card 20 that may have a content aperture 22. The cards may have hang holes 14, 24. A side view 1A is also shown. Hingedly attached to rear card 20 along a portion of the perimeter of content aperture 22 is a rear housing roof panel 42, which in turn is hingedly attached to rear wall panel 44, and thence to floor panel 46. Floor panel 46 is next hingedly attached to front housing front wall panel 34. Each side of front wall panel 34 is hingedly attached to the following panels in order, first, bevel panel 32, next front housing side panel 36, finally front housing flange panel 38. Bevel panel 32 is optional. Several bevels panels may be used if desired, at other locations as well. Openings such as view aperture 35 may be provided in the various panels.

Figure 2:
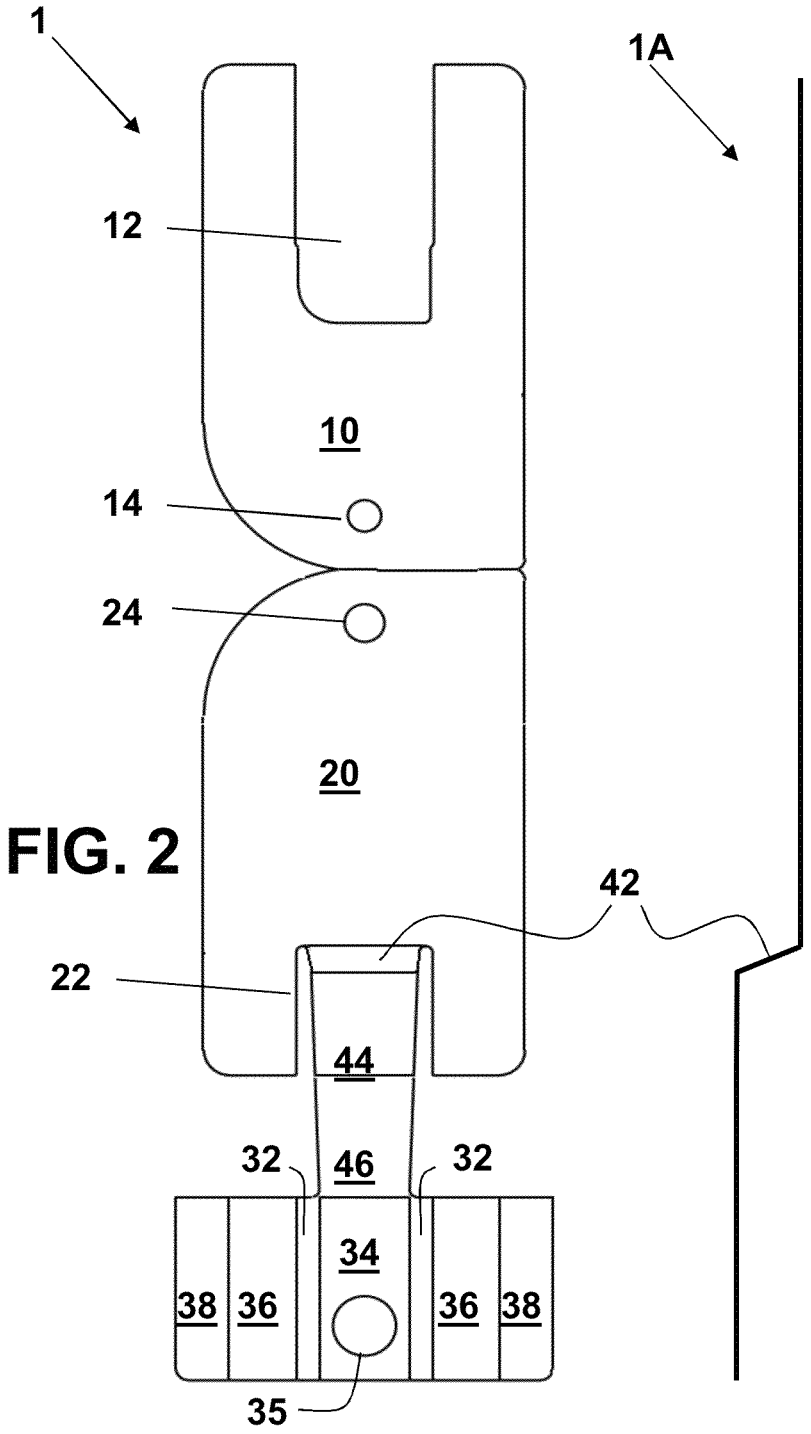
FIGS. 2-6 show plan and side views of steps in the formation of the package of FIG. 1.

FIG. 2 shows a first exemplary step in forming the blank shown in FIG. 1 into a package. Rear housing roof panel 42 is shown folded back beyond the plane of the back card 20.

Figure 3:
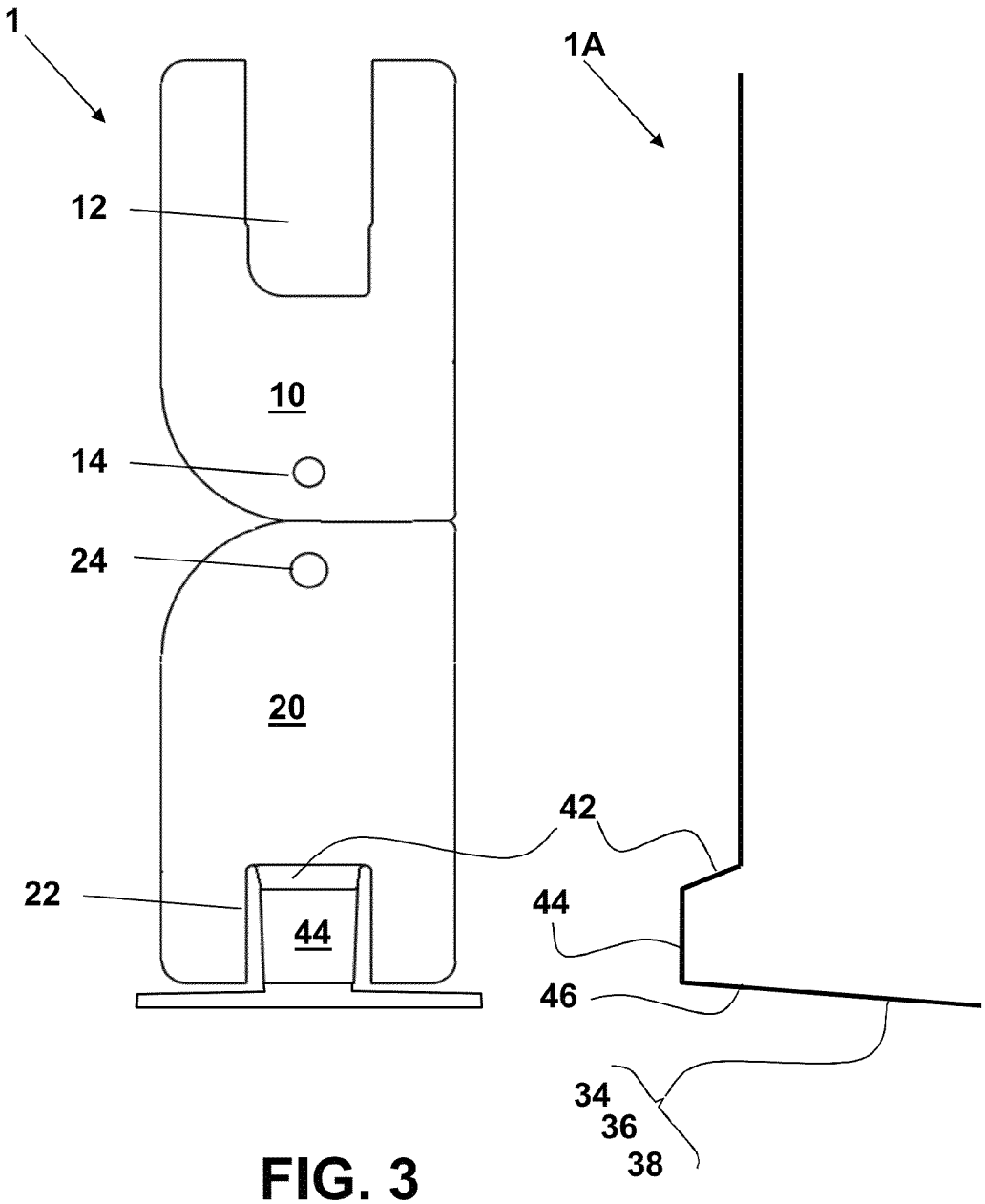

FIG. 3 shows another step, where floor panel 46, front wall panel 34, front housing side panels 36, and front housing flange panels 38 attached thereto are folded forward.

Figure 4:
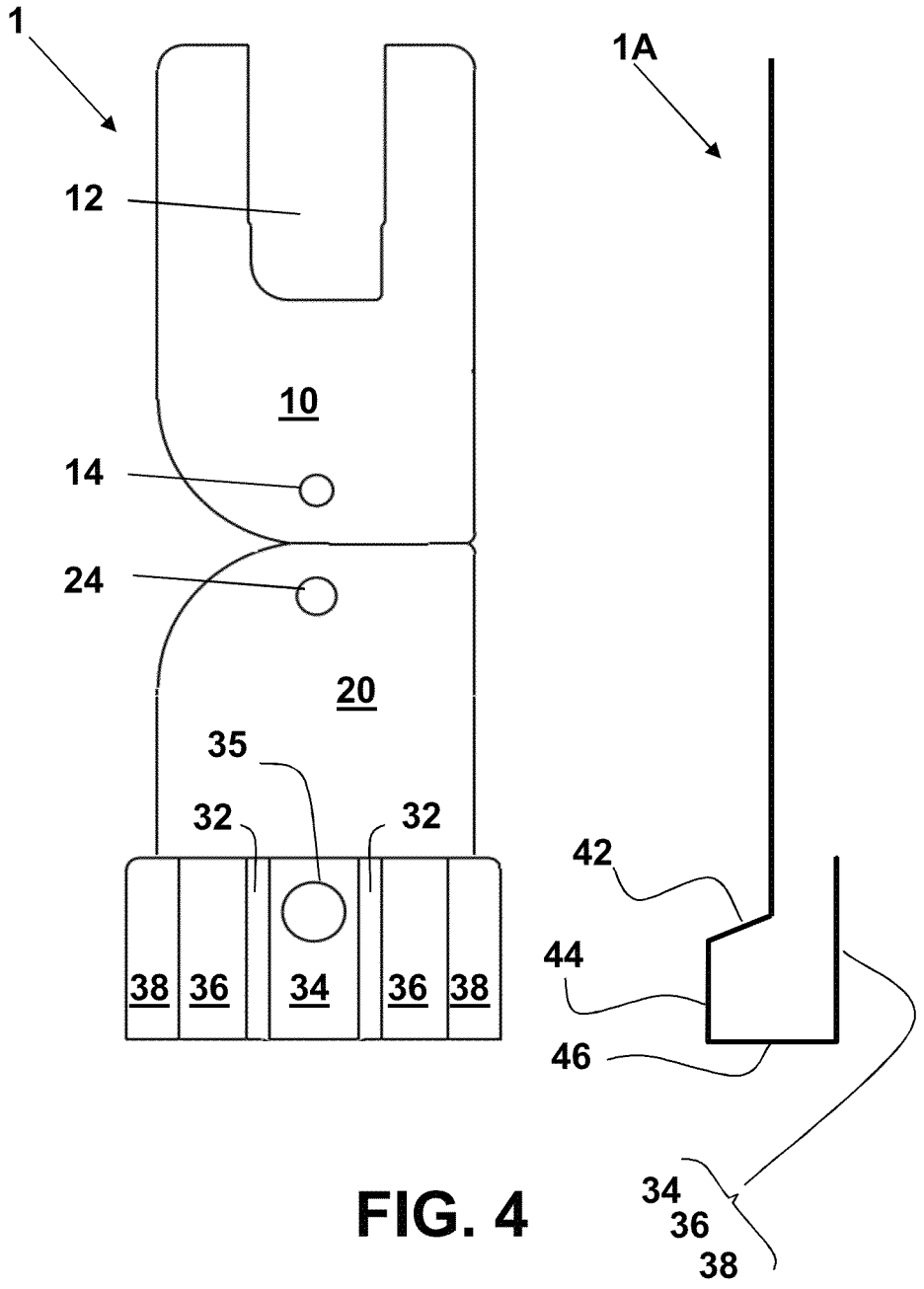

FIG. 4 shows yet another step, where the front wall panel 34, front housing side panels 36, and front housing flange panels 38 are folded upward.

Figure 5:
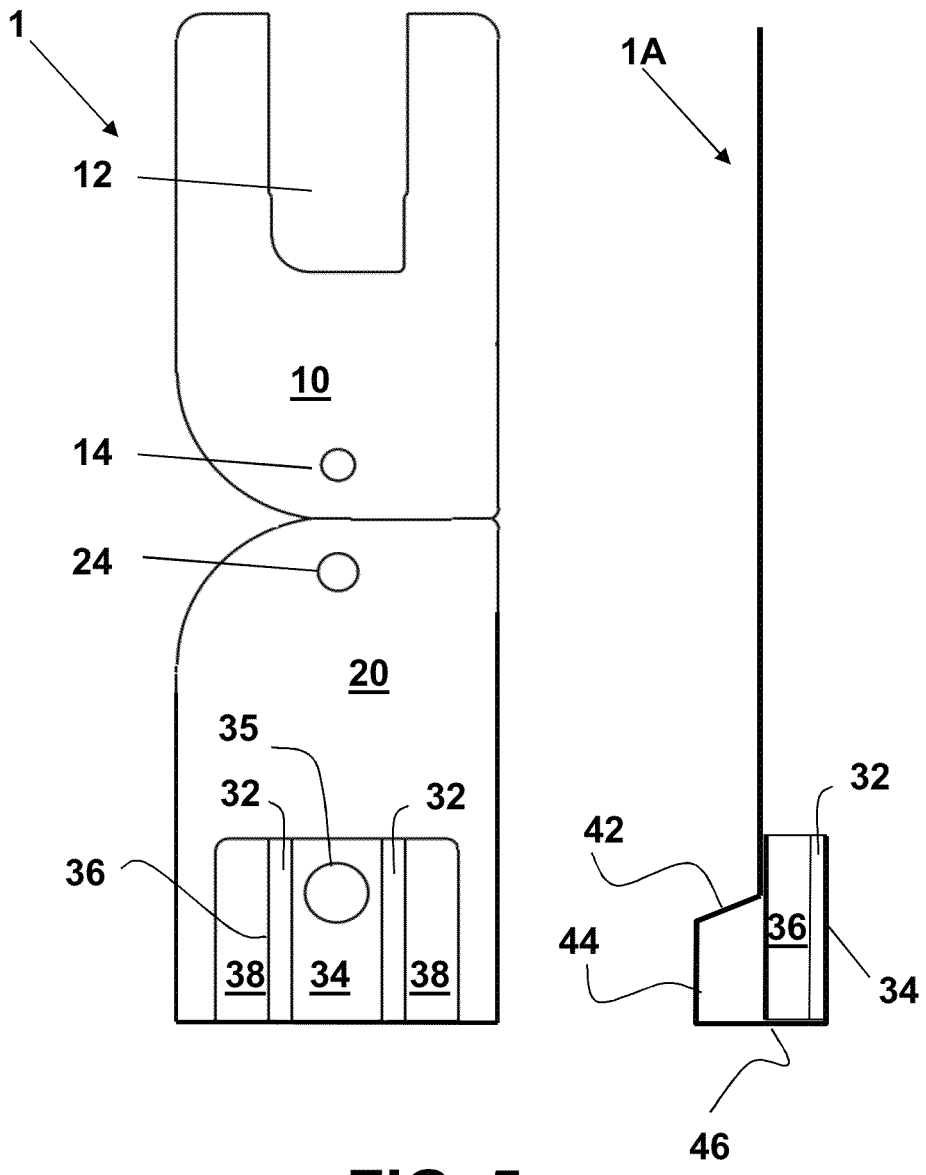

FIG. 5 shows another step, where the front housing side panels 36 are folded backward and the front housing flange panels 38 are folded to lie flat against rear card 20.

Figure 6:
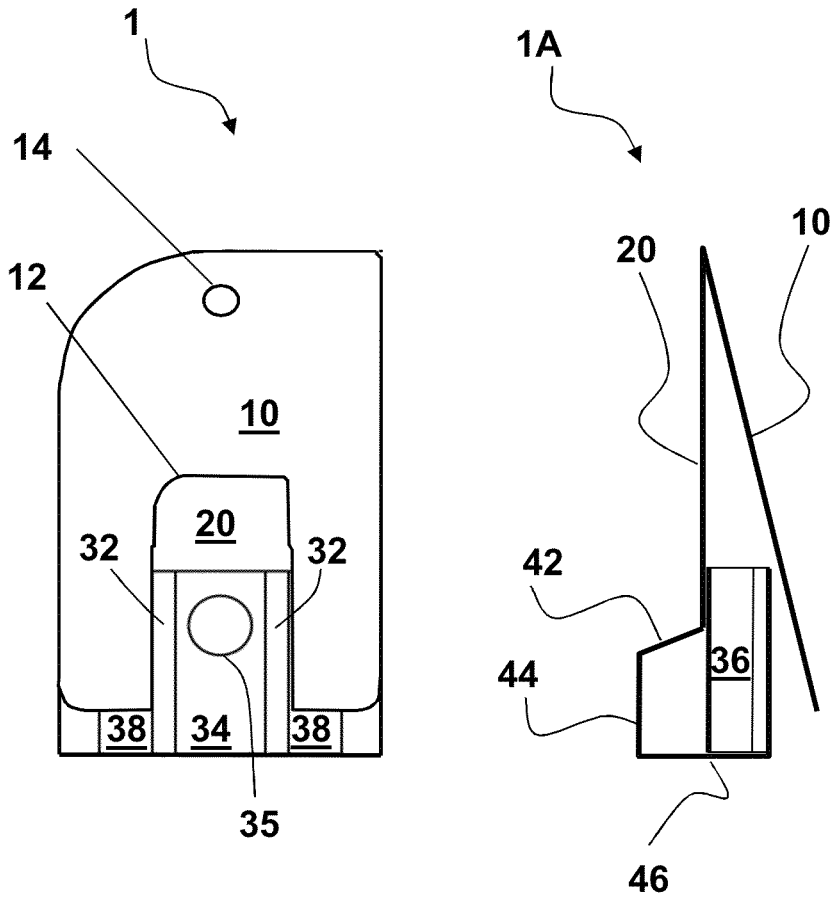

FIG. 6 shows another step where front card 10 is folded forward and over rear card 20, and front card content aperture 12 fits down around protruding front wall panel 34, front housing side panels 36, and front housing flange panels 38. Content may be placed into the package, and the various panels sealed to one another by heat sealing, glue, or other means.

Figure 7:
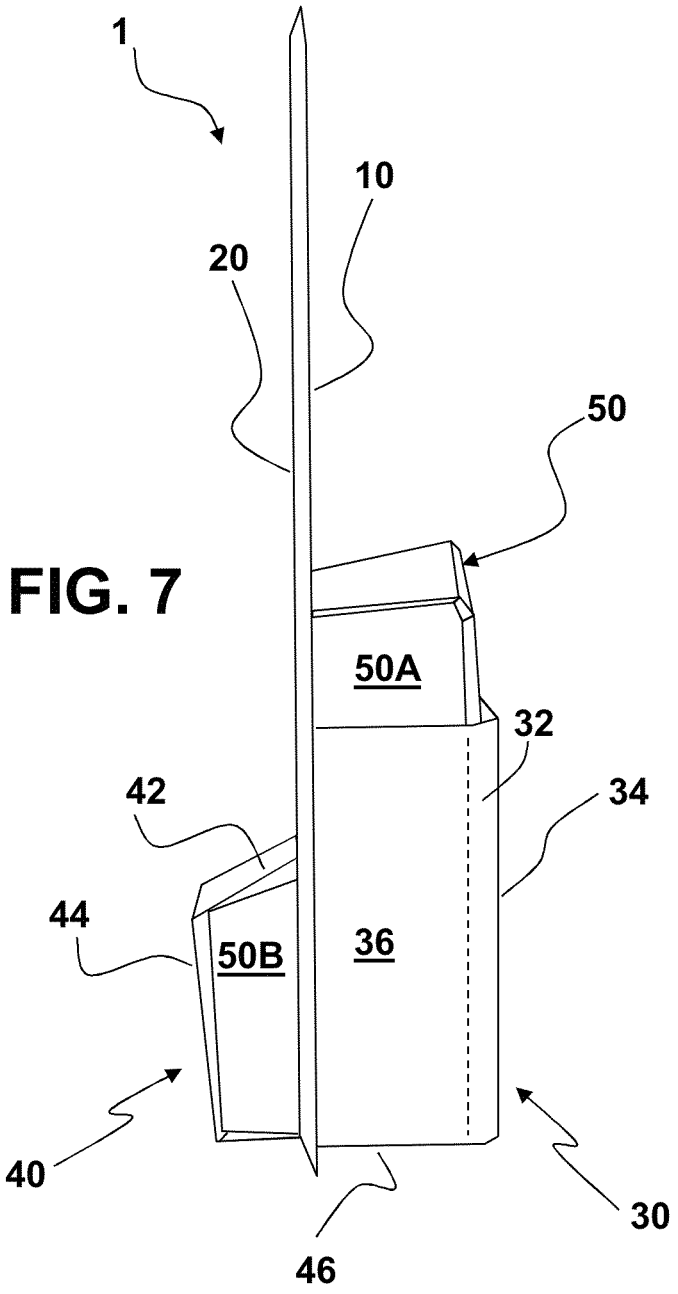
FIG. 7 shows a perspective side view of the resulting, finished package with enclosed content.

FIG. 7 shows another view of the finished package 1, containing an item 50 such as an inkjet cartridge having a somewhat irregular shape with a first portion 50A and second portion 50B. These portions may be received in package 1 into front housing 30 and rear housing 40, respectively. As shown for example in FIG. 7, front housing 30 may have the form of a sleeve with an open upper end, while rear housing 40 may have the form of pocket with open sides. Other forms of housing may be provided by suitable design of the blank.

Figure 8:
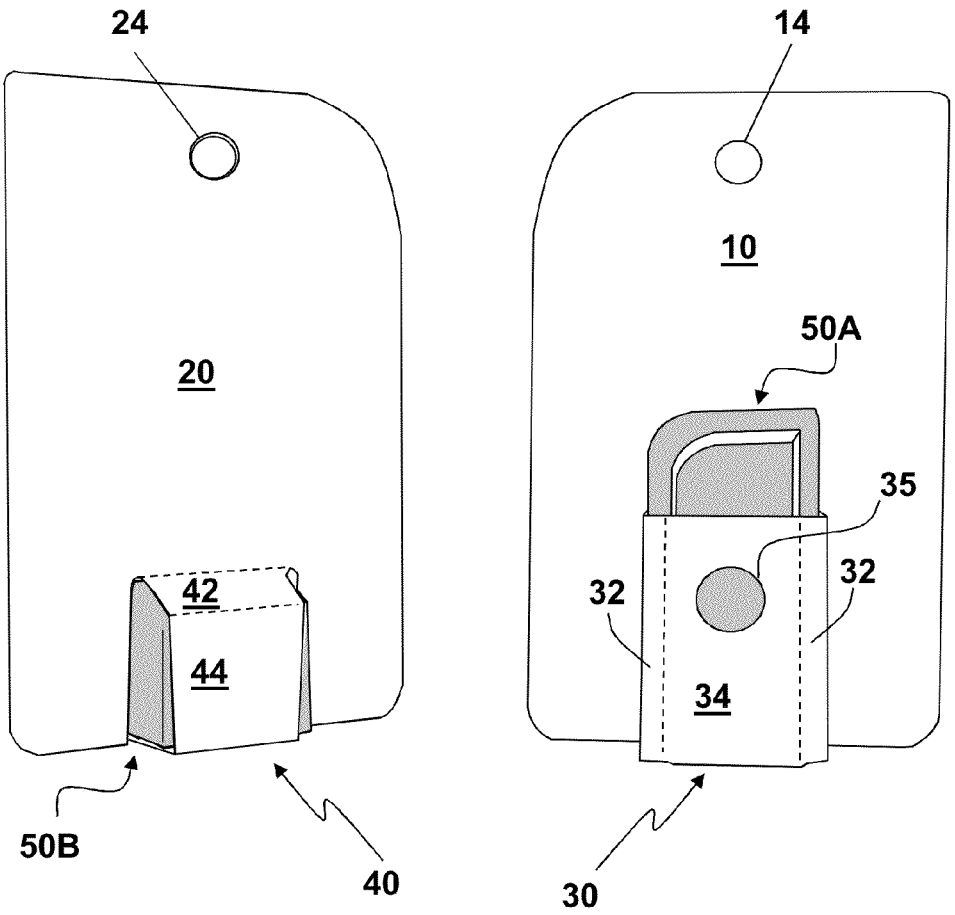
FIG. 8 shows perspective rear and front views of the finished package.

FIG. 8 shows perspective views of the rear and front of the package.

Figure 9:
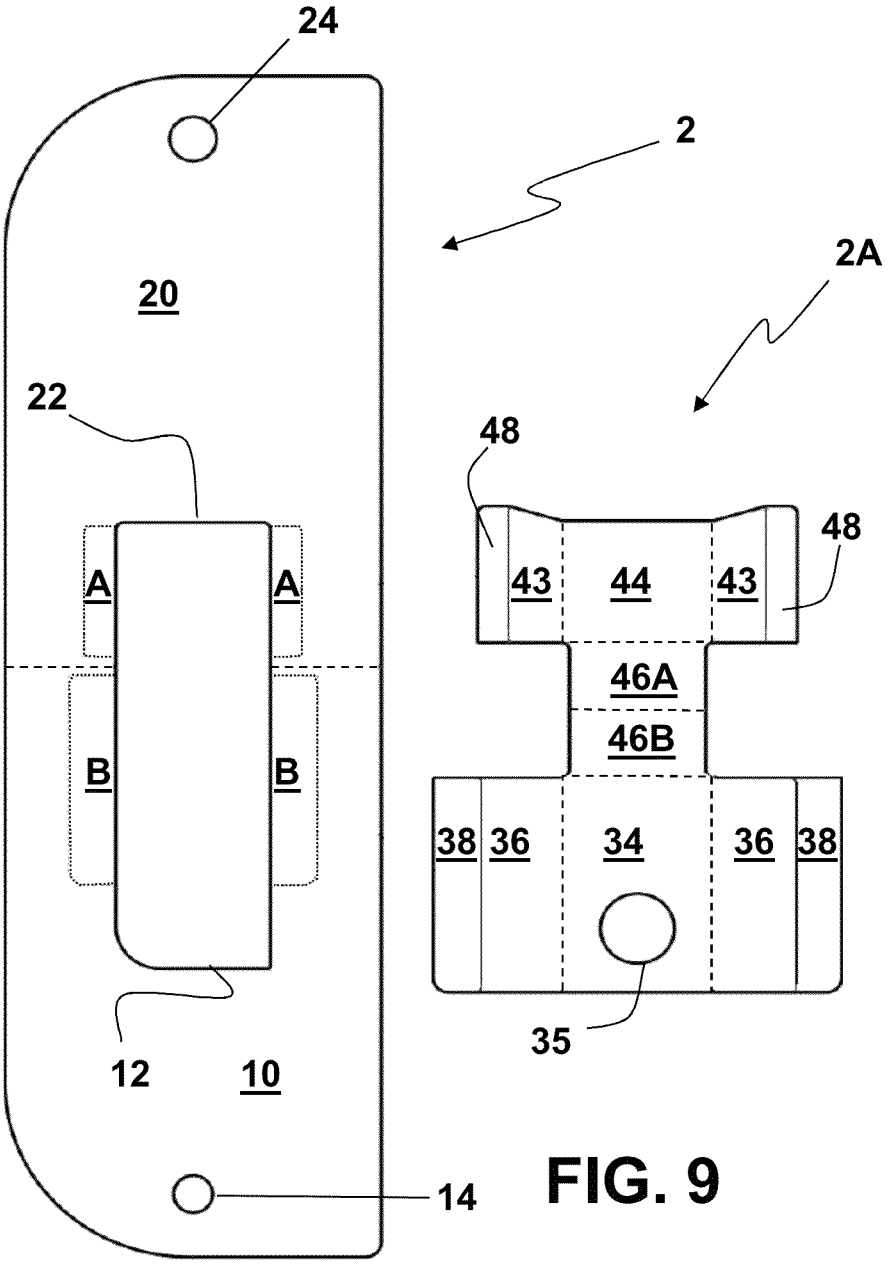
FIG. 9 shows plan views of the blanks for forming another exemplary package.

FIG. 9 shows a plan view of a blank for forming another package 2 including a front card 10 that may have a content aperture 12 and a rear card 20 that may have a content aperture 22. The cards may have hang holes 14, 24. Additional panels may be provided in a separate housing blank 2A, whose parts are similar to certain parts described earlier. These panels may rear wall panel 44 with hingedly attached rear side walls 43 and rear housing flange panels 48. The rear wall panel 44 may be hingedly attached to a floor including rear floor panel 46A and front floor panel 46B. Front floor panel 46B may further be attached to front wall panel 34. Each side of front wall panel 34 may be hingedly attached to the following panels in order, first, front housing side panel 36, and then front housing flange panel 38. Openings such as view aperture 35 may be provided in the various panels.

As housing blank 2A is separate from cards 10, 20, attachment locations may be provided on the cards for receiving the housing blank. For example attachment locations "A" may be provided to receive rear housing flange panels 48, and attachment locations "B" may be provided to receive front housing flange panels 38.

Figure 10:
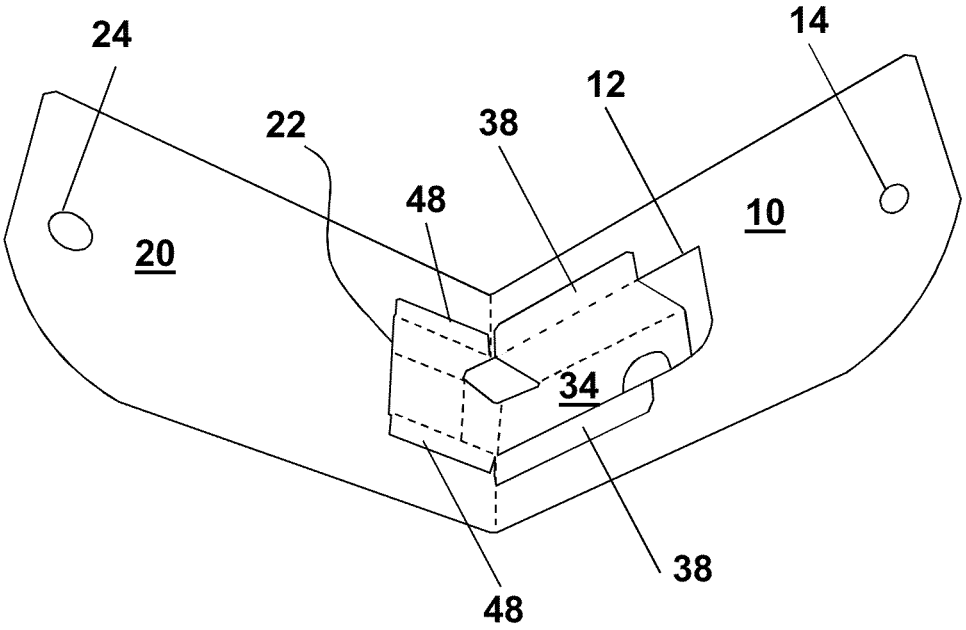
FIG. 10 shows a perspective view of a step in the formation of the package of FIG. 9.

FIG. 10 shows front card 10 and rear card 20 partly bent along a connecting hinge line, and with the folded housing blank 2A received into front card 10 and rear card 20 content apertures 12, 22 respectively. Rear housing flange panels 48 are shown in their respective attachment locations, to which they may be heat sealed, glued, or otherwise attached, or left somewhat loose to be sandwiched between front card 10 and rear card 20 during final assembly of the package.

Figure 11:
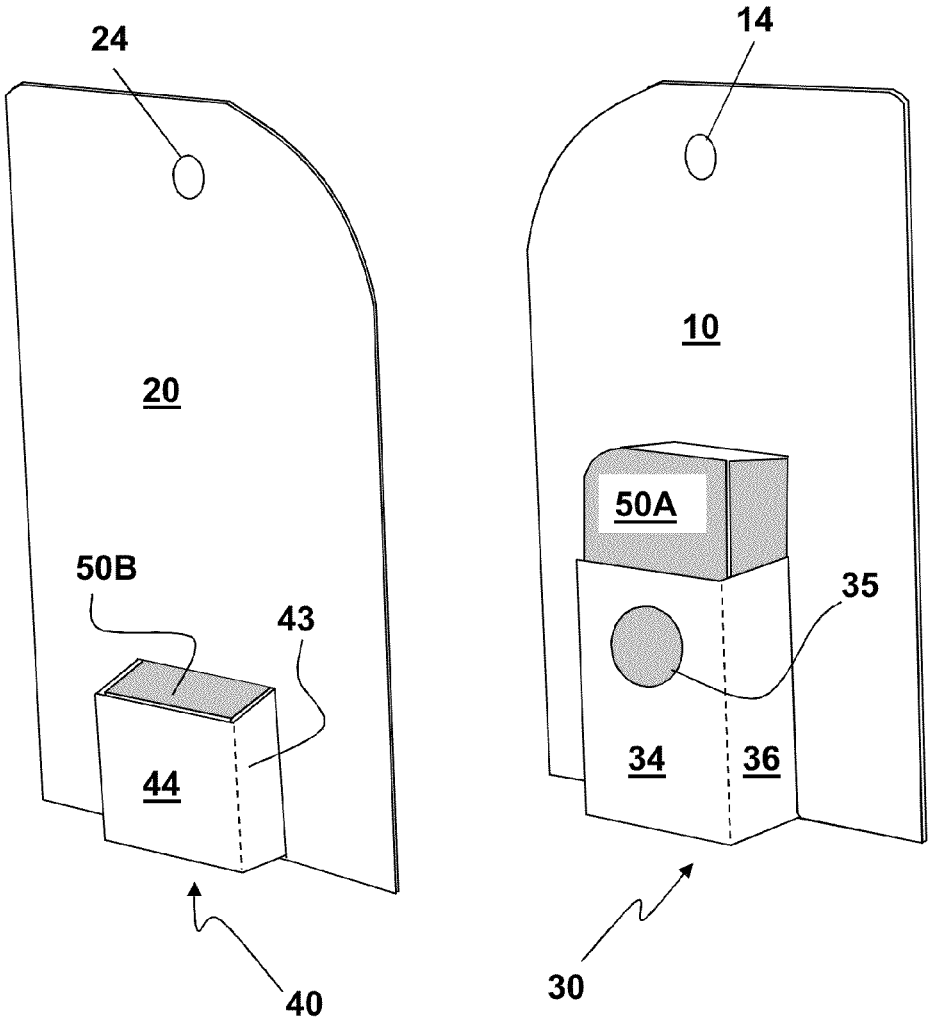
FIG. 11 shows perspective rear and front views of the finished package.

FIG. 11 shows perspective views of the rear and front of the package containing an item such as an inkjet cartridge having a somewhat irregular shape with a first portion 50A and second portion 50B. These portions may be received in package 2 into front housing 30 and rear housing 40, respectively. As shown for example in FIG. 11, front housing 30 may have the form of a sleeve with an open upper end, while rear housing 40 may have the form of pocket with an open top. Other forms of housing may be provided by suitable design of the housing blank.

For the packages shown here, when the front card 10 and rear card 20 have been brought together, they may be joined by heat sealing or other adhesive or mechanical means forming the package. The material used for the cards and panels may be coated on one or both surfaces. For example, one surface may have a graphics-receptive coating, while the opposite surface may have a coating for heat sealing and/or tear resistance. It may sometimes be desirable to have the graphic-receptive surfaces of the cards and straps to face outwards on the finished package, while the tear-resistant or heat-seal surfaces may face inwards. If more than one card is formed from a single blank, for example hingedly joined together, the blank may be designed so as to place the respective surfaces on the desired outward or inward orientation in the finished package.

The packages here may comprise paperboard or plastic, and may be opaque, translucent, or transparent. While the packages have been shown holding an example content item 50, it should be understood that other shapes of contents, may be housed within the packages.

The features described for various packages herein may be alone or in combination with other described features. It is to be understood that a variety of materials may be used to form these packages. However, for sustainability purposes, a paperboard based material may be used and for improved theft deterrence a tear resistant paperboard may be used. Package materials may include tear-proof materials such as DURAFOLD paperboard, tear-resistant materials such as NATRALOCK paperboard, as well as other types of paperboard or plastic materials. The packages may be made of one or more layers of material, including but not limited to one, two, three or more layers of material. Different parts of the packages may comprise different materials and/or different numbers of layers.

Packages made of tear-resistant material may be difficult to open without first initiating a tear, which can often most readily be done by using a knife or scissors. However, a package may be provided with a pre-cut tear initiation point, such as a perforation or a notch cut into the tear-resistant material, for example near its periphery. In such a case, to avoid unauthorized opening of the package before it is sold, a security tag may be used to cover up the tear initiation point. Use of a security device to cover a tear initiation point is also described in U.S. Provisional Application 61/025,102 filed on Jan. 31, 2008 and in International Application PCT/US09/32321 filed on Jan. 29, 2009, both of which are herein incorporated by reference in their respective entireties.

The packages disclosed herein may be comprised mostly of paperboard, for example as described in International Application PCT/US08/051245. The paperboard used in such packages may be tear-resistant as described in commonly assigned U.S. Pat. No. 7,144,635. However, the packages disclosed herein may also comprise plastic materials.

The packages disclosed herein may be made from one or several blanks (that is, the cut sheet parts from which the package components are made by folding and other steps). However, it should be understood that certain unitary blanks may be provided instead as more than one part, and certain blanks may be combined into single blanks, while still arriving at the same finished package.

Where more than one blank is used, the blanks may be assembled in various stages, including assembling a unitary blank into a package, assembling separate blanks and then joining them to form a package, and joining two or more blanks together, for example by heat sealing, gluing, mechanical fastening, or otherwise and then forming the combined blanks into the package.

Portions of the packages may be made of one, two, or more layers of material. It is to be understood that additional layers of material may be used based on manufacturing preferences. Portions of certain cards or panels may be folded over or around the portions of other cards or panels, creating multiple layers of material.

The invention claimed is:

1. A package comprising:

an item;

a first card comprising a content aperture in which at least a portion of the item is received, the card having first and second opposing surfaces;

a second card with a second content aperture;

a first content housing protruding away from the first opposing surface and at least partly enclosing a first volume, the first content housing formed of folded sheet material; and a second content housing protruding away from the second opposing surface and at least partly enclosing a second volume, the second content housing formed of folded sheet material;

wherein at least one of said first and second content housings comprises at least one flange and the at least one flange is held between the first and second cards;

wherein the first and second volumes are connected through the content aperture; and wherein neither of said content housings extends the full width of the first and second cards.

2. The package of claim 1, wherein the second content aperture receives at least one of the first and second housings.

3. The package of claim 1, wherein the card and housings are formed from separate pieces of material.

4. The package of claim 1, wherein the card and housings are formed from a single piece of material.

5. The package of claim 1, wherein said at least one of said housings has at least one open side.

6. The package of claim 1, wherein said at least one of said housings has six faces, one of said faces open to at least one content aperture, and at least four of said faces at least partly closed.

7. The package of claim 1, wherein at least one of said front card and housings are formed of a tear resistant material.

8. The package of claim 1, further comprising a view aperture in one of said housings.

9. The package of claim 1, wherein at least one of said card and housings comprise paperboard.

10. The package of claim 1, wherein said card and housings all comprise paperboard.

11. The package of claim 1, wherein at least one of the first and second content housings has the form of a pocket with open sides, and the other of the first and second content housings has closed sides.

12. A package comprising:

an item;

a front card comprising a content aperture, the front card defining a first plane;

a rear card comprising a second content aperture, the rear card defining a second plane;

a first content housing protruding forward relative to the first plane, the first content housing at least partly enclosing a first volume, the first content housing formed of folded sheet material;

a second content housing protruding rearward from the second plane, the second content housing at least partly enclosing a second volume, the second content housing formed of folded sheet material;

wherein the front and rear cards are at least partly joined together to form at least two plies wherein said first and second volumes are connected through the content apertures;

wherein at least a portion of the item is received in at least one of the content apertures;

wherein at least one of said front and rear cards extends laterally to both sides beyond said first and second content housings; and wherein at least one of said first and second content housings comprises at least one flange and the at least one flange is held between the front and rear cards.

13. The package of claim 12, wherein said cards and housings are formed from a single piece of material.

14. The package of claim 12, wherein said at least one of said housings has at least one open side.

15. The package of claim 12, wherein said at least one of said housings has six faces, one of said faces open to at least one content aperture, and at least four of said faces at least partly closed.

16. The package of claim 12, wherein at least one of said cards and housings are formed of a tear resistant material.

17. The package of claim 12, further comprising a view aperture in one of said housings.

18. The package of claim 12, wherein at least one of said cards and housings comprise paperboard.

19. The package of claim 12, wherein said cards and housings all comprise paperboard.

20. A package comprising:

a front card comprising a content aperture, the front card defining a first plane;

a rear card comprising a second content aperture, the rear card defining a second plane;

a first content housing protruding forward relative to the first plane, the first content housing at least partly enclosing a first volume, the first content housing formed of folded sheet material;

a second content housing protruding rearward from the second plane, the second content housing at least partly enclosing a second volume, the second content housing formed of folded sheet material;

wherein said first and second volumes are connected through the content apertures;

wherein at least one of said first and second content housings comprises at least one flange and the at least one flange is held between the front and rear cards; and an item held within the package, partially contained in each of said first and second volumes, and extending through the content apertures.

* * * * *